US005850947A

United States Patent [19]

Kim

[11] Patent Number: 5,850,947

[45] Date of Patent: Dec. 22, 1998

[54] INVERTIBLE AND MULTI-DIRECTIONAL FLUID DELIVERY DEVICE

[76] Inventor: Phillip S. Kim, 3301 Rodeo Rd., Los Angeles, Calif. 90018

[21] Appl. No.: 685,592

[22] Filed: Jul. 15, 1996

[51] Int. Cl.[6] ..... B05B 9/043

[52] U.S. Cl. ..... 222/321.4; 222/376; 222/382; 222/464.5; 222/464.6

[58] Field of Search ..... 222/321.4, 376, 222/382, 464.2, 464.3, 464.5, 464.6, 402.19

[56] References Cited

U.S. PATENT DOCUMENTS

| | | | |
|---|---|---|---|
| 1,181,783 | 5/1916 | Lyons | 222/464.6 X |
| 1,580,337 | 4/1926 | Schutten | 222/321.4 |
| 2,968,428 | 1/1961 | Samuel | 222/402.19 |
| 4,019,661 | 4/1977 | Szabo | 222/376 |
| 4,174,790 | 11/1979 | Nozawa . | |
| 4,277,001 | 7/1981 | Nozawa | 222/321.4 |
| 4,371,098 | 2/1983 | Nozawa . | |
| 4,775,079 | 10/1988 | Grothoff . | |
| 4,776,498 | 10/1988 | Maerte et al. . | |
| 4,823,991 | 4/1989 | Skorka . | |
| 4,966,313 | 10/1990 | Lina . | |
| 5,005,738 | 4/1991 | Tempelman | 222/402.19 |
| 5,186,365 | 2/1993 | Nolte | 222/464.5 X |
| 5,620,113 | 4/1997 | Meshberg | 222/321.4 X |

FOREIGN PATENT DOCUMENTS

| | | | |
|---|---|---|---|
| 218766 | 8/1957 | Australia | 222/402.19 |

*Primary Examiner*—Kevin P. Shaver

[57] ABSTRACT

The invention is an apparatus which enables the operation of a dispensing assembly in a container containing fluid from either an inverted (upside-down), angles, or upright position. The apparatus serves as a fluid intake tube, and is fitted into the dispensing assembly of a container containing a fluid. The apparatus is composed to two generally tubular parts mounted concentrically: an outer tube, and an inner tube. On the outer tube, buoyant ring(s) are located, with confer buoyancy to the outer tube. The outer tube is slightly shorter than the inner tube. When the apparatus is fitted into a fluid-filled container, and said container is held in an inverted or downward-angled position, the perforations located at the end of the inner tube proximal to the dispensing assembly are exposed. The exposed perforations provide for uptake of fluid in the tube into the dispensing assembly of the liquid container. In an upright or upward-angled position, the perforations of the inner tube are covered and sealed by the outer tube, this allowing uptake of the fluid from the bottom of the apparatus into the dispensing assembly. The apparatus operates without a pressurized system, without pistons, and without the need for multiple chambers. The apparatus is self-adjusting insofar as it will operate in an inverted or tilted position without the need to push buttons or to otherwise manipulate the apparatus.

6 Claims, 10 Drawing Sheets

INVERTIBLE AND MULTI-DIRECTIONAL FLUID DELIVERY DEVICE

BACKGROUND OF THE INVENTION

The invention relates to a tube, or dipstick, used to deliver fluid or other media within a container to a dispensing assembly or device, such as a pump, pressure, or manual sprayer. Specifically, the invention relates to an apparatus which feeds fluid or other media out of a container whether it is in an upright, angled, or inverted position. The invention self-adjusts as the position of the container changes and the position of the media within that container changes, thus permitting operation of the dispensing assembly in any position, without the need to manipulate the assembly or any portion of the container.

The invention improves on prior art because it does not require push-button operation, nor is it complicated by multiple chambers, a piston, or a pressurized chamber.

The liquid dispenser in U.S. Pat. No. 4,019,661 to Szabo, 17 Jul. 1975, required that manually applied force be applied to a push button located at the base of the fluid container in order to select operation from upside-down position. The present invention addresses the problem presented by the Szabo dispenser by eliminating the need for manual force or for selecting a setting in order to dispense the fluid from an inverted position. The present invention can be operated from various angles, including an inverted position, without manipulation of the media delivery assembly itself.

The liquid dispensers in U.S. Pat. No. 4,371,098 to Nozawa et al., 01 Feb. 1983, and U.S. Pat. No. 4,174,790 to Nozawa et al., 10 Apr. 1978, are capable of dispensing fluid from a upside position only through the use of a pressurizing chamber. The upright/inverted pump sprayer of U.S. Pat. No. 4,775,079 to Grothoff 04 Oct. 1988, and invertible pump of U.S. Pat. No. 4,776,498 to Mearte and Wolter, 11 Oct. 1988, both require the presence of a piston to dispense fluids from an inverted position. The invertible pump in U.S. Pat. No. 4,823,991 to Skorka, 25, Apr. 1989, requires two pump chambers to effectively dispense fluid from an inverted container, and the device of U.S. Pat. No. 4,996,313, to Lina, 30 Oct. 1990, requires a central bush to create two chambers in series.

The present invention improves on all of the above described devices, as its design is relatively simple. Because the present invention does not require multiple chambers, pistons, or pressurizing chambers, it enables manufacture under more economically favorable conditions, and a lower market price, and therefore provides more affordable availability to the consumer. In addition, because the present invention is self-adjusting, it provides the user with the ease of "automatic" use.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the claims.

BRIEF SUMMARY OF THE INVENTION

The present invention is directed to the delivery of liquid or other media to a dispensing assembly from a container that is in either an upright, angled, or inverted position. The apparatus is comprised of a single chamber in a tube-within-a-tube. The invention is an apparatus which requires few parts, and provides the advantage of low industrial manufacture cost.

Briefly, the invention is placed in a container containing liquid or other media, and it is adapted to fit to a liquid delivery assembly or device. The invention is a simple apparatus made up of two concentric tubes: an inner tube within an outer tube. The inner tube contains perforations at the end proximal to the fluid delivery device. The outer tube is a slightly shorter outer tube that contains two buoyancy rings. The perforated inner tube, also known as a care, is sheathed by the outer buoyant tube. When the container is upright or angled upwards, and the bottom of the core is immersed in media, the outer tube slides up to cover and seal the perforations of the core, allowing for liquid or other media to be drawn through the core towards the connection to the delivery assembly or device, and into the delivery assembly located there. When the container is inverted or angled downward, with liquid or other media occupying the area of the container connected to the delivery assembly, the outer tube automatically moves, due to the buoyancy rings, towards the base of the container. This movement of the outer tube exposes the perforations located near the top of the core, thus allowing media to enter the core and flow into the connection to the fluid device container and the delivery assembly that is connected there.

BRIEF DESCRIPTION OF THE DRAWINGS

The accompanying drawings, which are incorporated in and consitute a part of the specification, schematically illustrate a preferred embodiment of the invention and, together with the general description given above and detailed description of the preferred embodiment given below, serve to explain the principles of the invention.

DETAILED DESCRIPTION

Figure 1:
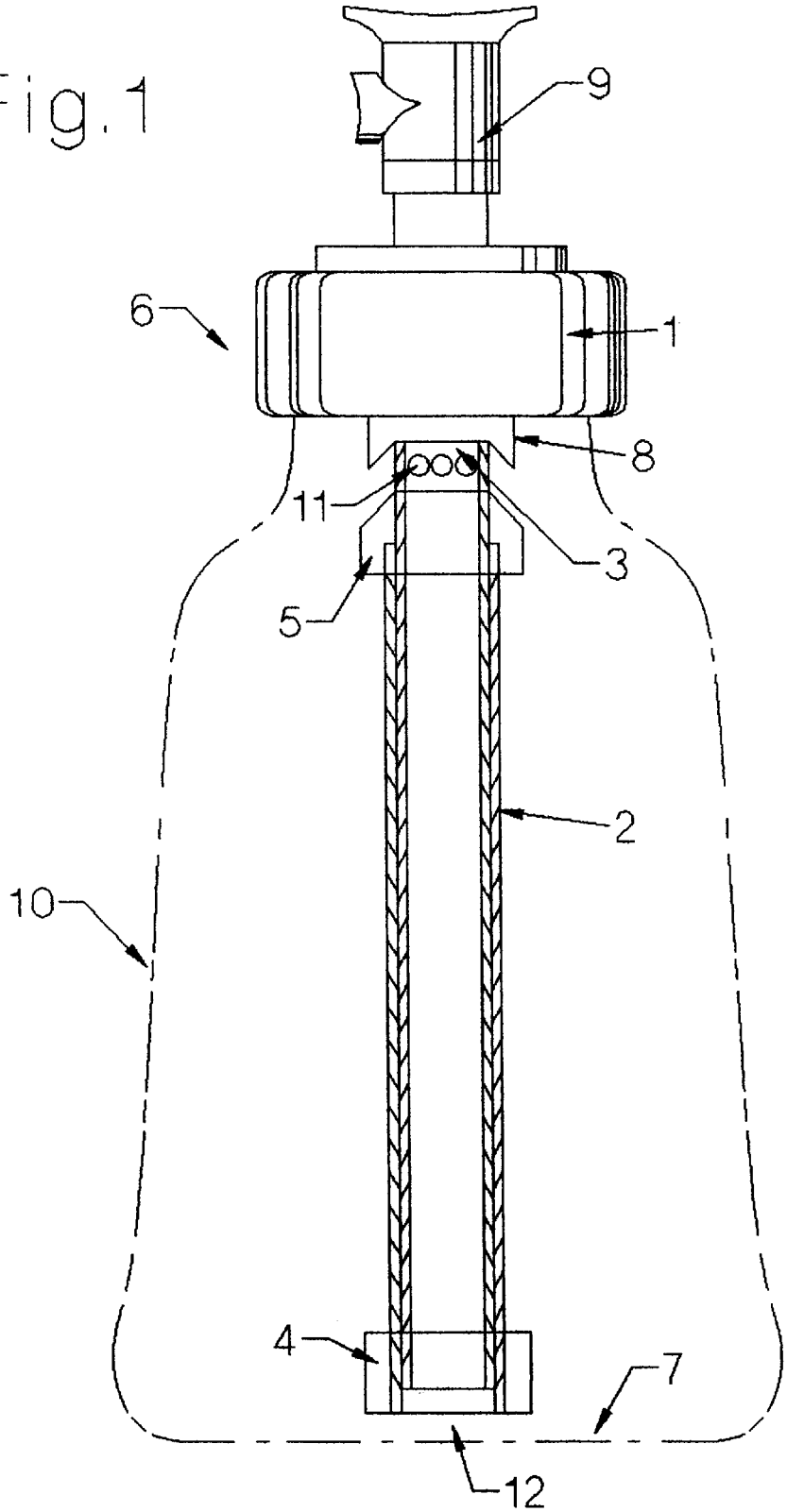
FIG. 1 is a side view of the invention as seen installed in a cut-away view of an empty liquid or other media dispenser.

The present invention will be described in terms of the preferred embodiment. The preferred embodiment is an apparatus which delivers liquid or other media from a container in either an upright, angled, or inverted position, to a media dispensing assembly or device. Such a structure (1) is shown in FIG. 1, which depicts the invertible, multi-directional delivery apparatus installed in a media container (10) and connected to an outlet channel (8) on a fluid delivery assembly.

The core (3) is attached to a connection that leads to a media delivery assembly (9). The core is perforated (11) at its top and is tightly sheathed by a slightly shorter outer sleeve or tube (2), which is made buoyant with buoyancy rings (4, 5) located at the top and bottom of the outer tube.

Figure 2:
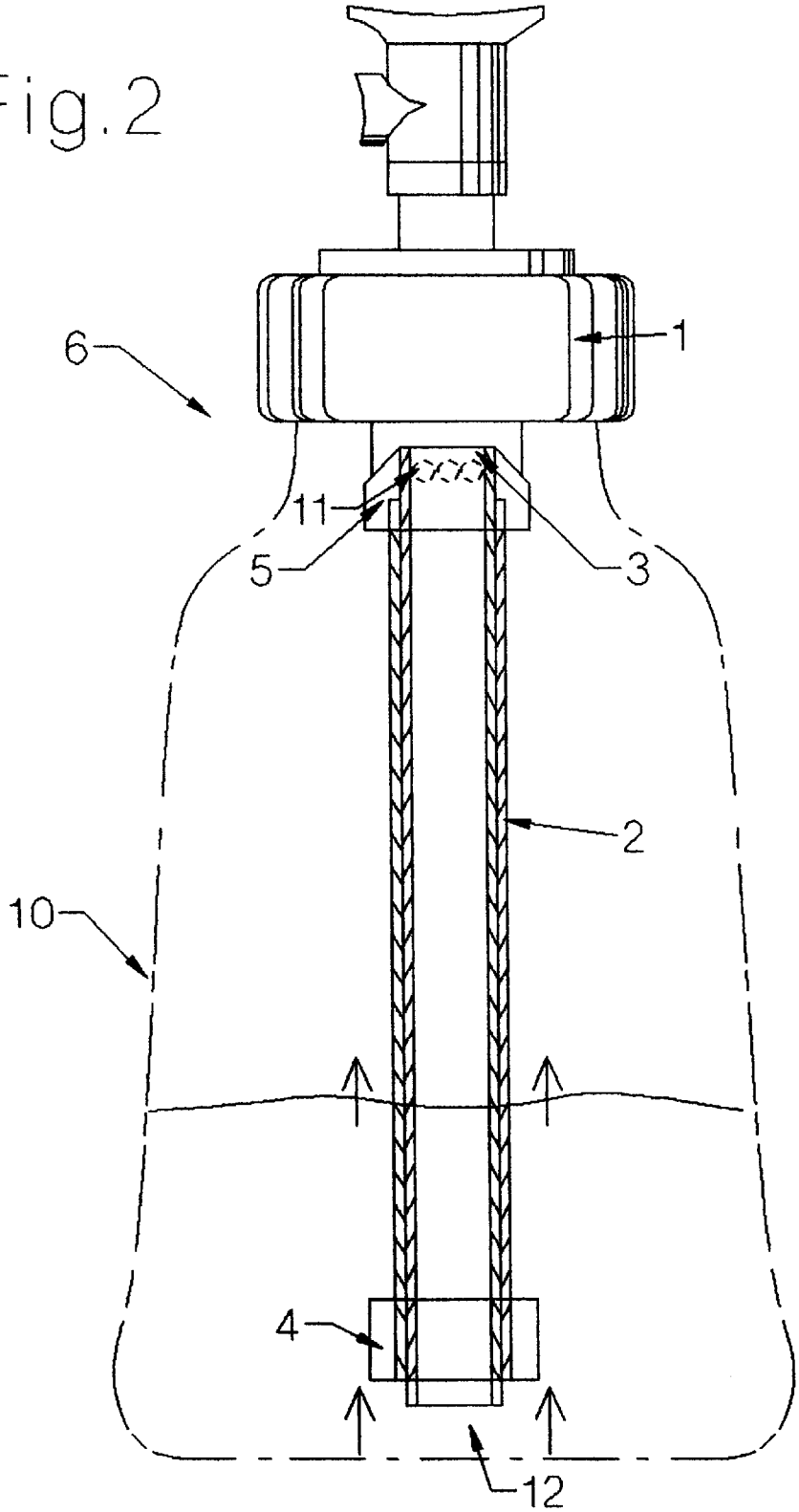
FIG. 2 is a side view of the invention as seen installed in a cut-away view of a partially filled liquid or other media dispenser held in an upright position.
Figure 3:
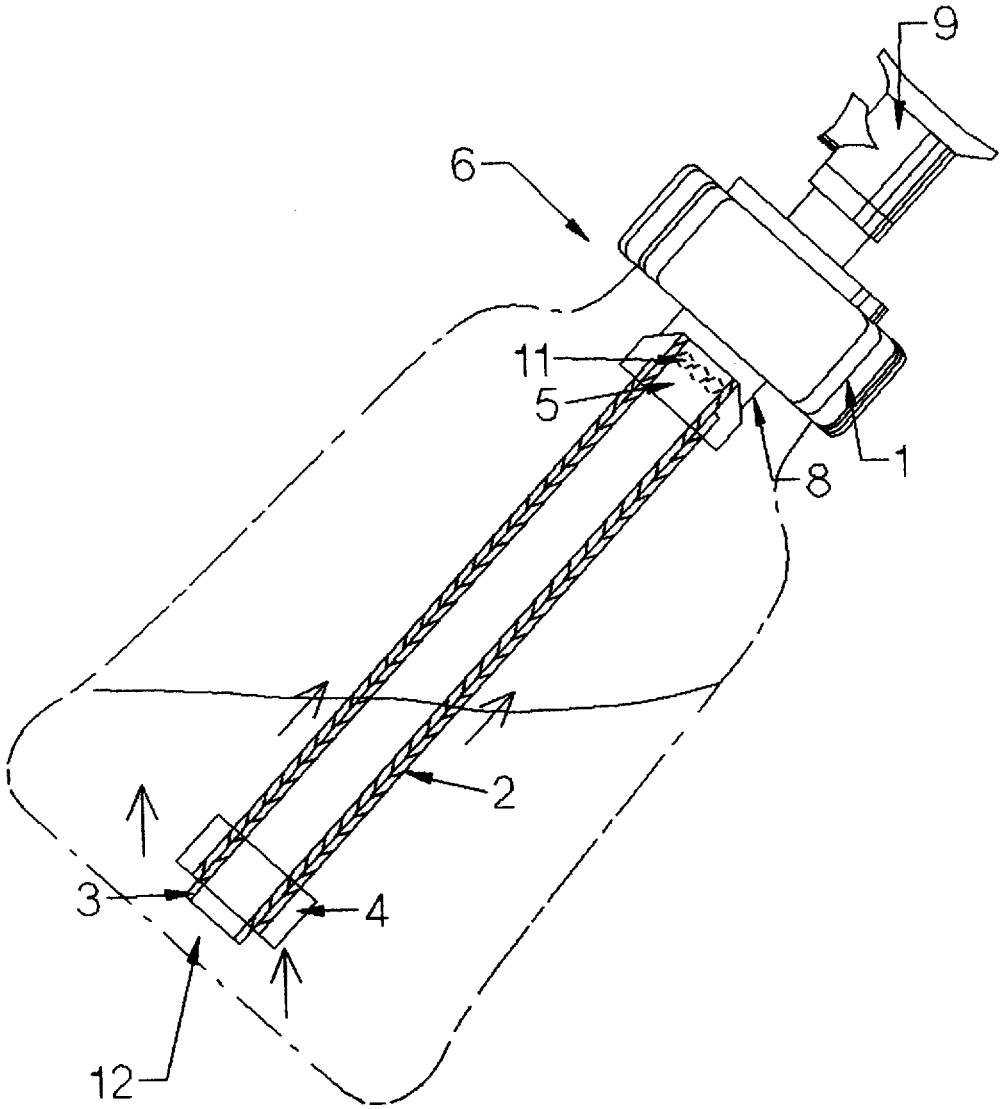
FIG. 3 is a side view of the invention as seen installed in a cut-away view of a partially filled liquid or other dispenser held at an upward angle.

FIG. 2 shows the apparatus placed in a media container (10) and held in an upright position. FIG. 3 shows the apparatus placed in a media container held in an upward-angled position. Depending on the amount and location of the media in the container, the outer buoyant tube (2) will slide upwards towards the container outlet (6). As the outer tube (2) slides upwards, the perforations (11) at the top of the core (3) are covered and sealed, allowing for the continuous flow of media up from the bottom of the core into the channel of the core (12), and then through the attached delivery assembly (8, 9).

Figure 4:
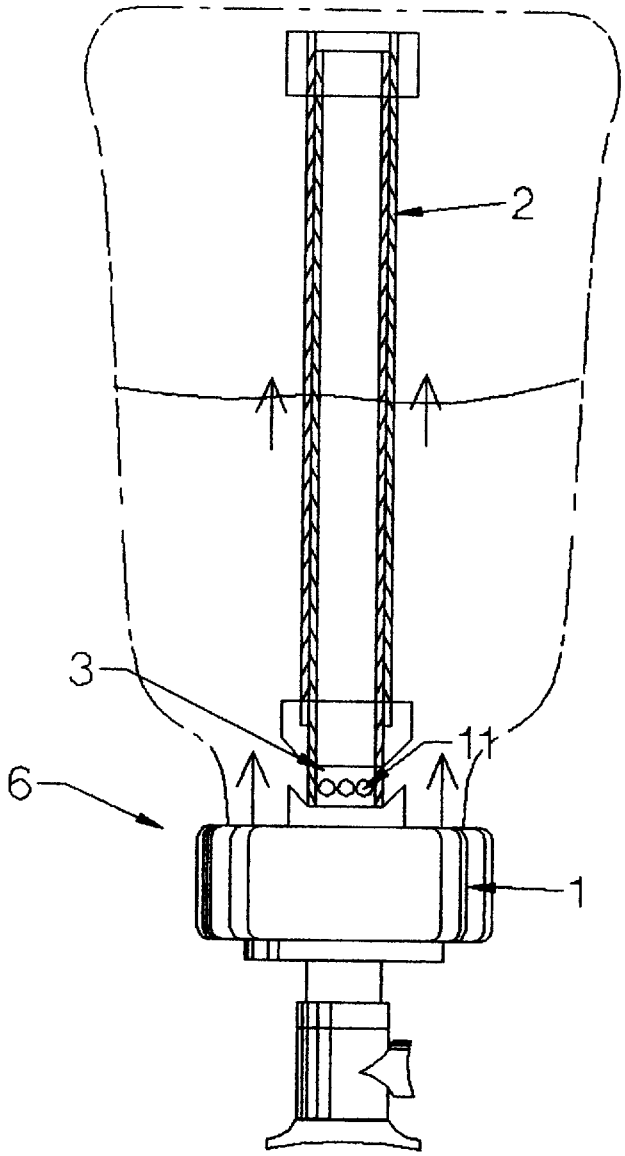
FIG. 4 is a side view of the invention as seen installed in a cut-away view of a partially filled liquid or other media dispenser held upside-down.
Figure 5:
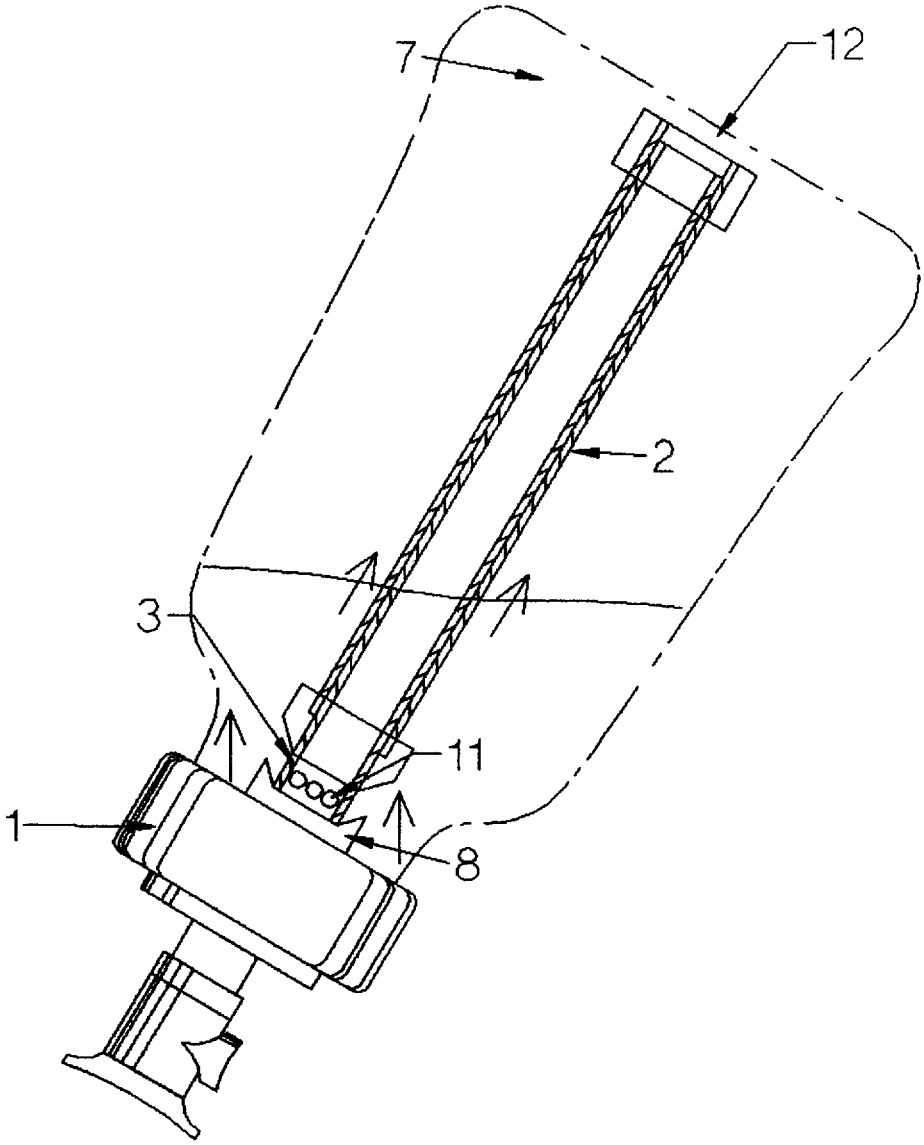
FIG. 5 is a side view of the invention as seen installed in a cut-away view of a partially filled liquid or other media dispenser held at a downward angle.

FIG. 4 shows the media delivery apparatus placed in a container held in an inverted position. FIG. 5 shows the media delivery apparatus placed in a container held in a downward-angled position. When media pools at the head of the container (6), the buoyant outer tube (2) moves towards the base of the container (7) and exposes the perforations (11) of the core (3). Once the perforations are exposed, liquid enters the core (12) and is passed through the connection to the delivery device (8).

Figure 6:
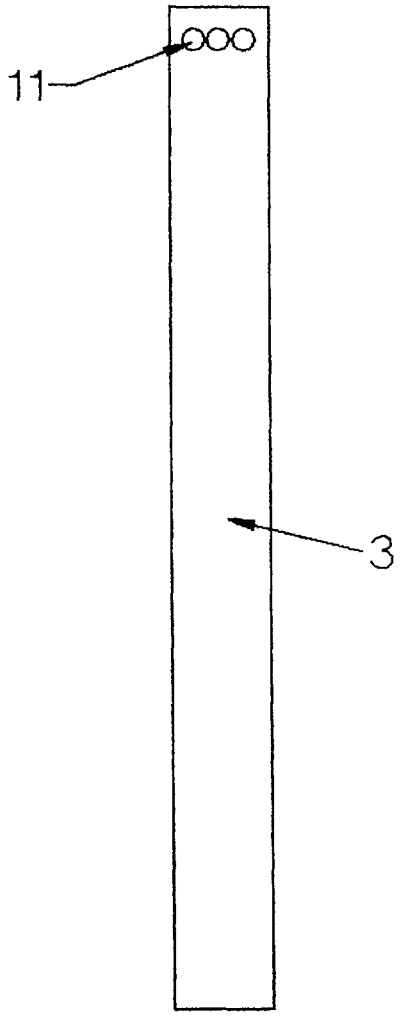
FIG. 6 is a side view of the invention perforated inner tube, or cone.
Figure 7:
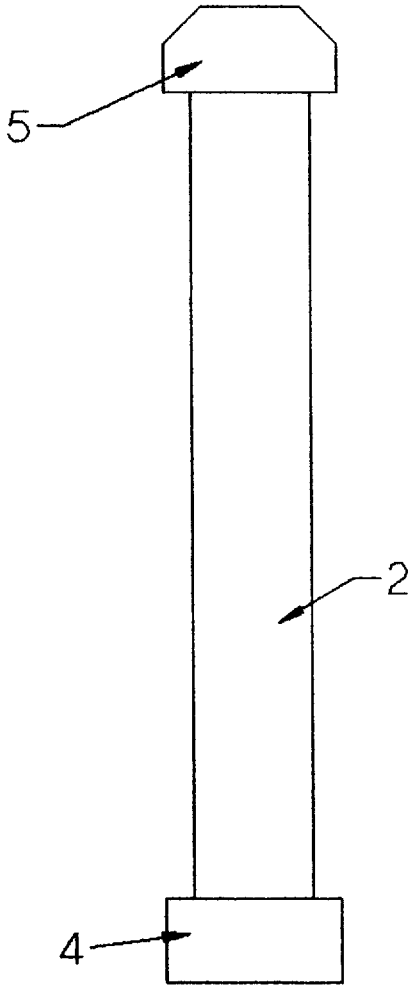
FIG. 7 is a side view of the invention's buoyancy-ringed outer tube.

The invention is basically made up of two concentric tubes. FIG. 6 shows the core tube (3) which contains perforations (11) at the top, and is designed to span nearly the entire length of the media container to which it is fitted. FIG. 7 shows the outer tube (2) which has two buoyant rings attached, one at the top and one at the bottom of the outer tube (4, 5), and which is shorter than the core to the degree that, in its lowered position, it will permit exposure of the perforations of the core (11).

Figure 8A:
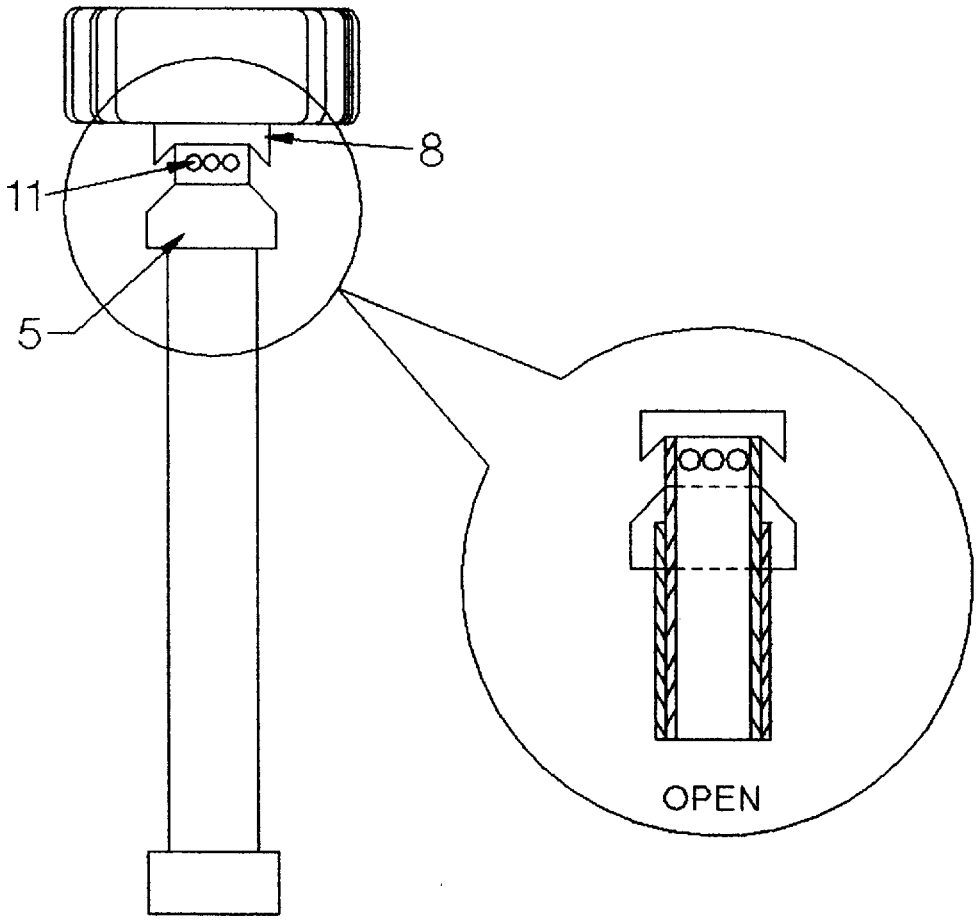
FIG. 8A is a side view of the invention fitted into the bottom of a dispensing device, with an enlarged view of the tapered upper buoyancy ring in the open position.
Figure 8B:
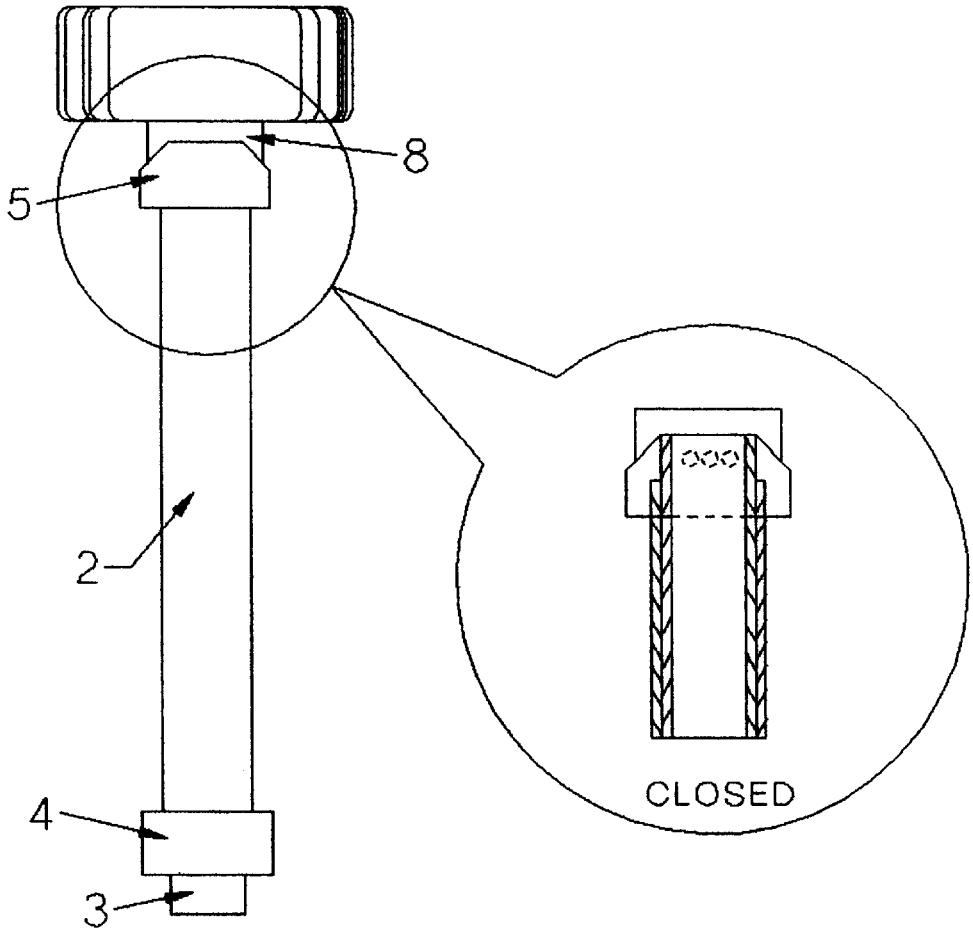
FIG. 8B is a side view of the invention fitted into the bottom of a dispensing device, with an enlarged view of the tapered upper buoyancy ring in the closed position.

A tight seal is made between the upper buoyancy ring (5) and the connection to the delivery device when the container is upright or upwardly angled. FIG. 8A and 8B show that the upper buoyancy ring (5) is made with an inwardedly tapering top, so that the ring fits tightly into the opening of the connection to the fluid or media delivery device (8) in order to form a seal which excludes air and media from entering the core channel via the perforations. FIG. 8A shows the perforations in an open position; FIG. 8A shows the perforations in a closed position, sealed by the outer tube (2).

Figure 9:
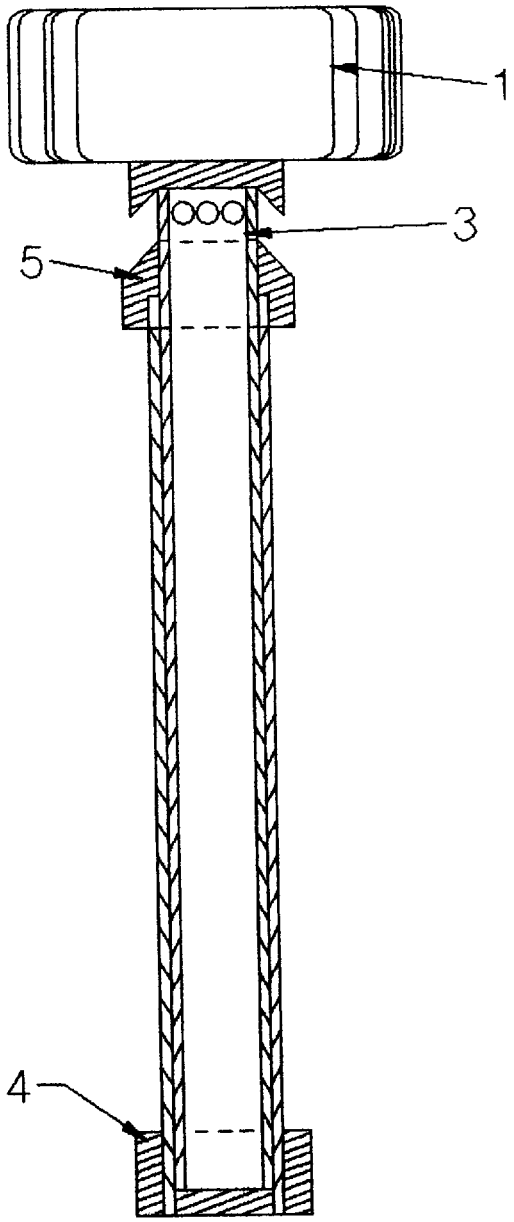
FIG. 9 is an enlargement of the invention fitted into the bottom of a convention outlet channel.

FIG. 9 shows that, when the media delivery device is in operation, and depending on the position and mount of media in the container, and on the angle at which the media container is held, the outer tube slides along the length of the core.

In summary, an apparatus and method for delivery of media from a container, whether the container is in an upright, angled, or inverted position, and without the need for pressurized chamber or for multiple chambers, has been described.

The present invention has been described in terms of a preferred embodiment. The invention, however, is not limited to the embodiment depicted and described. Rather, the scope of the invention is defined by the appended claims.

What is claimed is:

1. An apparatus for delivery of fluid from within a container when in either an upright or an inverted position, said apparatus comprising:

a container containing a fluid;

a dispenser assembly mounted to the container; and a tubular device disposed within the container which comprises a buoyant first tube and a perforated second tube, said second tube being coupled to and in fluid communication with the dispenser assembly and being concentrically disposed with the first tube such that said first tube slides freely relative to the second tube, the perforations within the second tube being disposed proximal to the dispenser assembly, the level of fluid within the container and the position of the container causing the first tube to either seal or expose the perforations in the second tube, wherein, when the container is in the upright position, the perforations are sealed by said first tube and fluid is drawn into the second tube at its end distal to the dispenser assembly and when the container is in the inverted position, the perforations are exposed and fluid is drawn into the second tube through the perforations proximal to the dispenser assembly.

2. The apparatus of claim 1 wherein said buoyant first tube is made buoyant through the attachment of buoyant material to said first tube.

3. The apparatus of claim 1, wherein said buoyant first tube is made buoyant by the attachment of at least one buoyant ring thereof.

4. The apparatus of claim 3, wherein said at least one buoyant ring comprises first and second buoyant rings.

5. The apparatus of claim 4, wherein said buoyant rings are attached to opposite ends of the first tube.

6. The apparatus of claim 1, wherein said buoyant first tube is shorter than said second tube.

* * * * *